US006553591B1

(12) United States Patent
Motosko

(10) Patent No.: US 6,553,591 B1
(45) Date of Patent: Apr. 29, 2003

(54) FLUID-CONTAINING BODY SUPPORT AIR CUSHION

(76) Inventor: Stephen J. Motosko, 132 Sand Dollar La., Sarasota, FL (US) 34242

( * ) Notice: Subject to any disclaimer, the term of this patent is extended or adjusted under 35 U.S.C. 154(b) by 0 days.

(21) Appl. No.: 09/886,709

(22) Filed: Jun. 21, 2001

(51) Int. Cl.[7] ..... A47C 27/08
(52) U.S. Cl. ..... 5/655.5; 5/654; 5/683
(58) Field of Search ..... 5/655.5, 654, 689, 5/665, 682, 693

(56) References Cited

U.S. PATENT DOCUMENTS

| | | | | |
|---|---|---|---|---|
| 1,371,919 A | | 3/1921 | Mahony | |
| 3,712,674 A | | 1/1973 | Ando | |
| 3,766,579 A | | 10/1973 | Shields | |
| 3,803,647 A | | 4/1974 | Reswick | |
| 4,079,473 A | * | 3/1978 | Phillips | 5/681 |
| 4,247,963 A | | 2/1981 | Reddi | |
| 4,389,742 A | | 6/1983 | DeWitt | |
| 4,391,466 A | | 7/1983 | Smith | |
| 4,405,129 A | | 9/1983 | Stuckey | |
| 4,638,518 A | | 1/1987 | Barbulla | |
| 4,724,560 A | | 2/1988 | Christie | |
| 4,738,486 A | | 4/1988 | Surber | |
| 4,876,756 A | | 10/1989 | Vaccaro | |
| 4,882,800 A | | 11/1989 | Schueler | |
| 4,901,386 A | | 2/1990 | Lane | |
| 4,945,588 A | | 8/1990 | Cassidy et al. | |
| 5,010,607 A | * | 4/1991 | Sobie | 5/682 |
| 5,044,030 A | | 9/1991 | Balaton | |
| 5,072,469 A | | 12/1991 | Boyd | |
| 5,107,557 A | | 4/1992 | Boyd | |
| 5,555,580 A | | 9/1996 | Hsia | |
| 5,598,593 A | | 2/1997 | Wolfe | |
| 5,604,945 A | | 2/1997 | Fisher et al. | |
| 5,642,544 A | | 7/1997 | Munoz | |
| 5,727,269 A | | 3/1998 | Chung | |
| 5,845,353 A | | 12/1998 | Chow | |

* cited by examiner

*Primary Examiner*—Lynne H. Browne
*Assistant Examiner*—Fredrick Conley
(74) *Attorney, Agent, or Firm*—Charles J. Prescott

(57) ABSTRACT

A fluid-containing air cushion including an air chamber including an air fill valve and a water filled layer connected atop or against, and at least partially coextensive with, the air chamber, the water-filled layer defining a body support surface. The water-filled layer includes a water fill valve and an array of individual spaced fluid pockets each of which is separated from, but in fluid communication with, the water-filled layer itself by a small fluid flow port whereby, when water flows into each of the fluid pockets through the port, it is substantially trapped within each of said fluid pockets to prevent substantial sloshing and uneven distribution of water within the water-filled layer.

1 Claim, 6 Drawing Sheets

FIG. 6
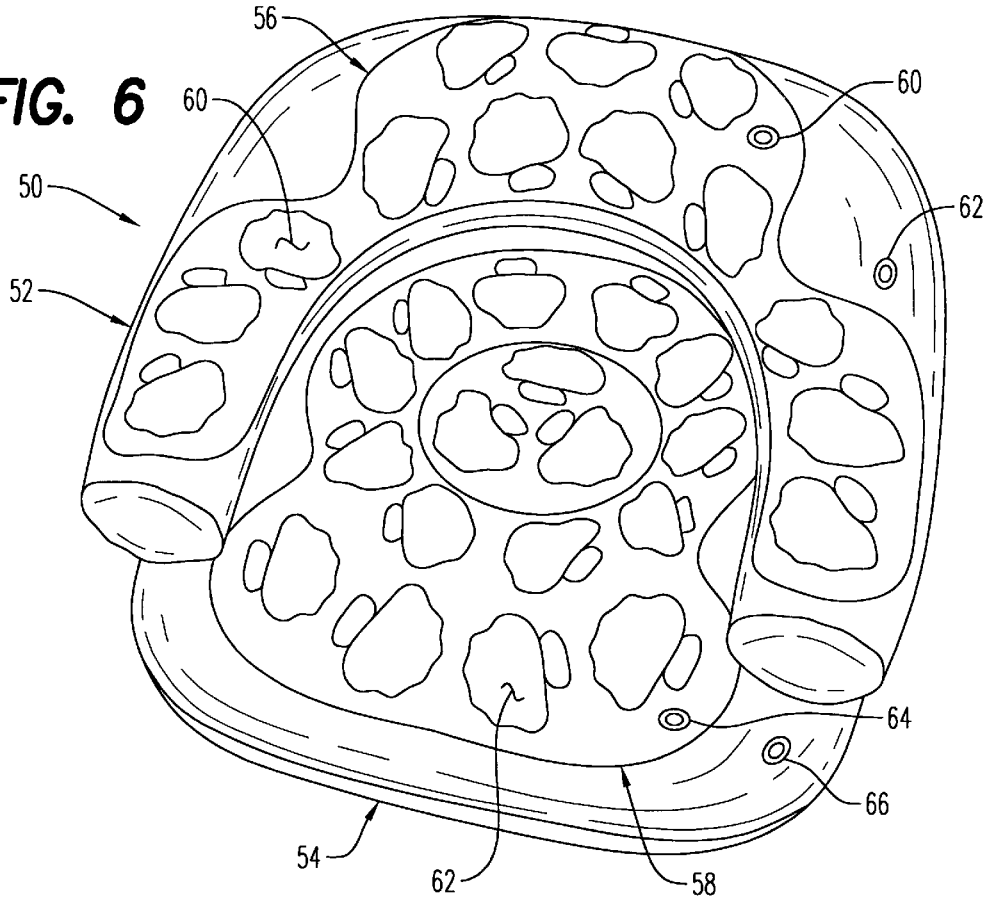
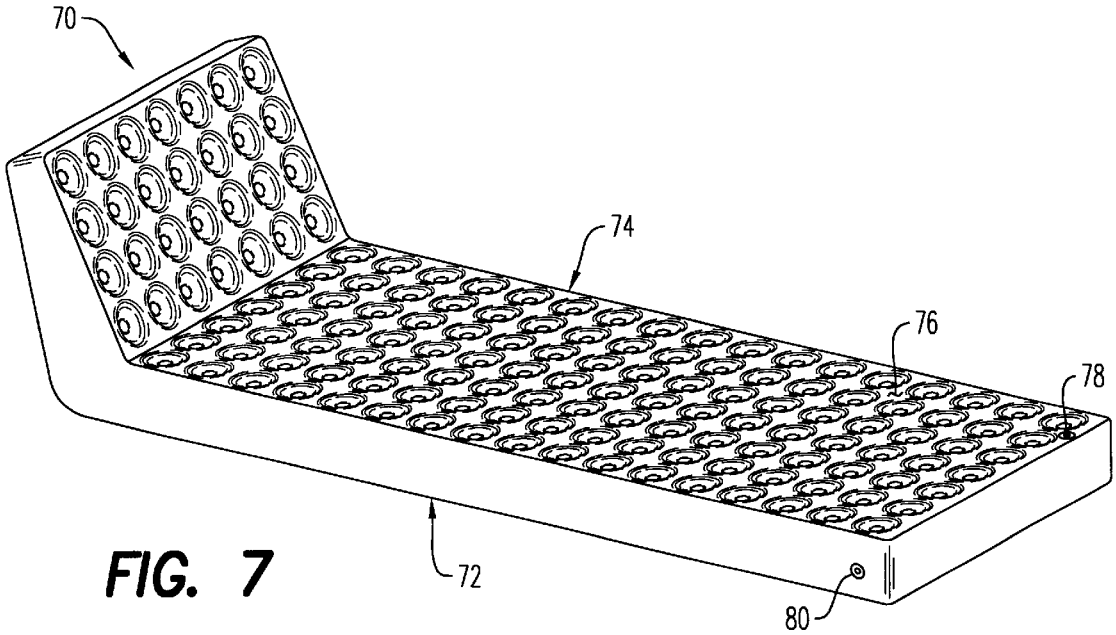
FIG. 7

FLUID-CONTAINING BODY SUPPORT AIR CUSHION

BACKGROUND OF THE INVENTION

1. Scope of Invention

This invention relates generally to combination fluid and air body support cushions and mattresses, and more particularly to such a device having an air chamber and a uniquely structured upper water layer positioned atop or against the air chamber for beneficial body support while minimizing sloshing and uneven distribution of water in the water layer.

2. Prior Art

Several air mattress and inflatable mattresses and body supports are known to applicant as described in the following U.S. patents:

U.S. Pat. No. 3,766,579 Shields
U.S. Pat. No. 4,945,588 Cassidy et al.
U.S. Pat. No. 4,638,518 Barbulla
U.S. Pat. No. 5,555,580 Hsia
U.S. Pat. No. 4,882,800 Schueler
U.S. Pat. No. 4,901,386 Lane
U.S. Pat. No. 3,803,647 Reswick
U.S. Pat. No. 5,072,469 Boyd
U.S. Pat. No. 5,107,557 Boyd
U.S. Pat. No. 5,845,353 Chow
U.S. Pat. No. 5,727,269 Chung
U.S. Pat. No. 3,712,674 Ando
U.S. Pat. No. 4,391,466 Smith
U.S. Pat. No. 4,738,486 Surber U.S. Pat. No. '579 water bed invention by Shields teaches a water bed comprised of both air beams acting as a supporting framework and an air mattress positioned within that framework, the air mattress supporting a water envelope positioned thereupon. Cassidy, in U.S. Pat. No. '588 also teaches an air/water mattress having a lower water chamber and a coextensive upper air chamber and a complex inflation system therewith.

In U.S. Pat. No. '518, Barbulla discloses another waterbed mattress structure comprised of a plurality of water chambers surrounded by stiffening air chambers at the boarders thereof. Hsia, in U.S. Pat. No. '580 shows still another waterbed with inner communicable air chambers alternately spaced between generally coextensive elongated water chambers.

In U.S. Pat. No. '800, Schueler discloses a flotation mattress having an enclosed inner area divided into three sequential sections, each of which includes alternating water columns and ventilation chambers. An adjustable water mattress is disclosed in U.S. Pat. No. '386 invented by Lane having an air chamber contained within a liquid filled bladder and an upper foam layer for body support.

The remaining above listed U.S. patents are substantially more diverse from the structural teaching of the present invention which is directed to a personal support cushion which may be utilized in and of itself atop a support surface or as a flotation device in water or as a seat section of a lounge chair floatable in water or supported atop the ground.

The following additional U.S. patents also disclose combination water/air body support structures. However, none of these disclose the unique features of the upper water layer of the present invention which substantially reduces the sloshing and/or pooling or collecting of water so as to distort the otherwise uniform thickness of the upper water-filled layer. Those additional patents are as follows:

U.S. Pat. No. 5,044,030 issued to Blaton
U.S. Pat. No. 5,642,544 issued to Munoz
U.S. Pat. No. 4,876,756 issued to Vaccaro
U.S. Pat. No. 4,724,560 issued to Christie
U.S. Pat. No. 4,389,742 issued to DeWitt
U.S. Pat. No. 4,247,963 issued to Reddi
U.S. Pat. No. 4,405,129 issued to Stuckey
U.S. Pat. No. 1,371,919 issued to Mahony
U.S. Pat. No. 5,598,593 issued to Wolfe
U.S. Pat. No. 5,604,945 issued to Fisher et al.

BRIEF SUMMARY OF THE INVENTION

This invention is directed to a fluid-containing air cushion including an air chamber including an air fill valve and a water-filled layer connected atop or against, and at least partially coextensive with, the air chamber, the water-filled layer defining a body support surface. The water-filled layer includes a water fill valve and an array of individual spaced fluid pockets each of which is separated from, but in fluid communication with, the water-filled layer itself by a small fluid flow port whereby water flows into each of the fluid pockets through the port and is substantially maintained within each of said fluid pockets, preventing substantial sloshing and uneven distribution of water within the water-filled layer which may be oriented horizontally at an angle and be flat or arcuate.

It is therefore an object of this invention to provide a simple, yet unique and effective personal body support cushion for an individual which takes advantage of the lightness of an air chamber support while also providing a uniquely configured water filled upper layer positioned directly atop the air chamber for making supportive contact with the body of the user.

It is another object of this invention to provide a fluid-containing air body support cushion utilizing an air chamber and a water-filled layer generally coextensive with a portion of the air chamber and which substantially prevents the sloshing and pooling of water within the water-filled layer, even when angularly oriented to horizontal or arcuate in form.

In accordance with these and other objects which will become apparent hereinafter, the instant invention will now be described with reference to the accompanying drawings.

BRIEF DESCRIPTION OF THE DRAWINGS

FIG. 6 is a perspective view of yet another embodiment of the invention in the form of an overstuffed chair.

FIG. 7 is a perspective view of still another embodiment of the invention in the form of an elongated chaise lounge.

DETAILED DESCRIPTION OF THE INVENTION

Figure 1:
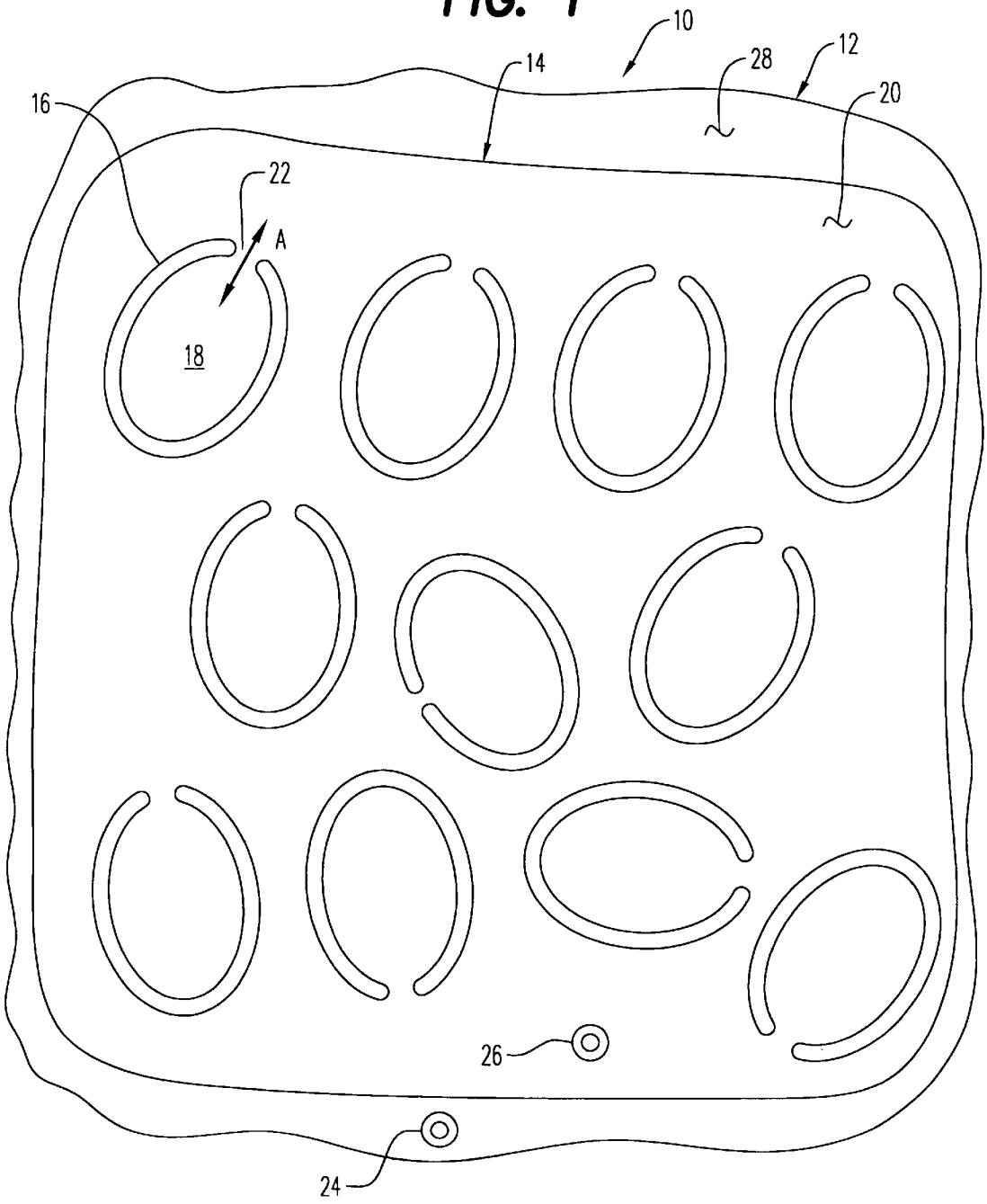
FIG. 1 is a top plan view of a generic embodiment of the invention.
Figure 2:
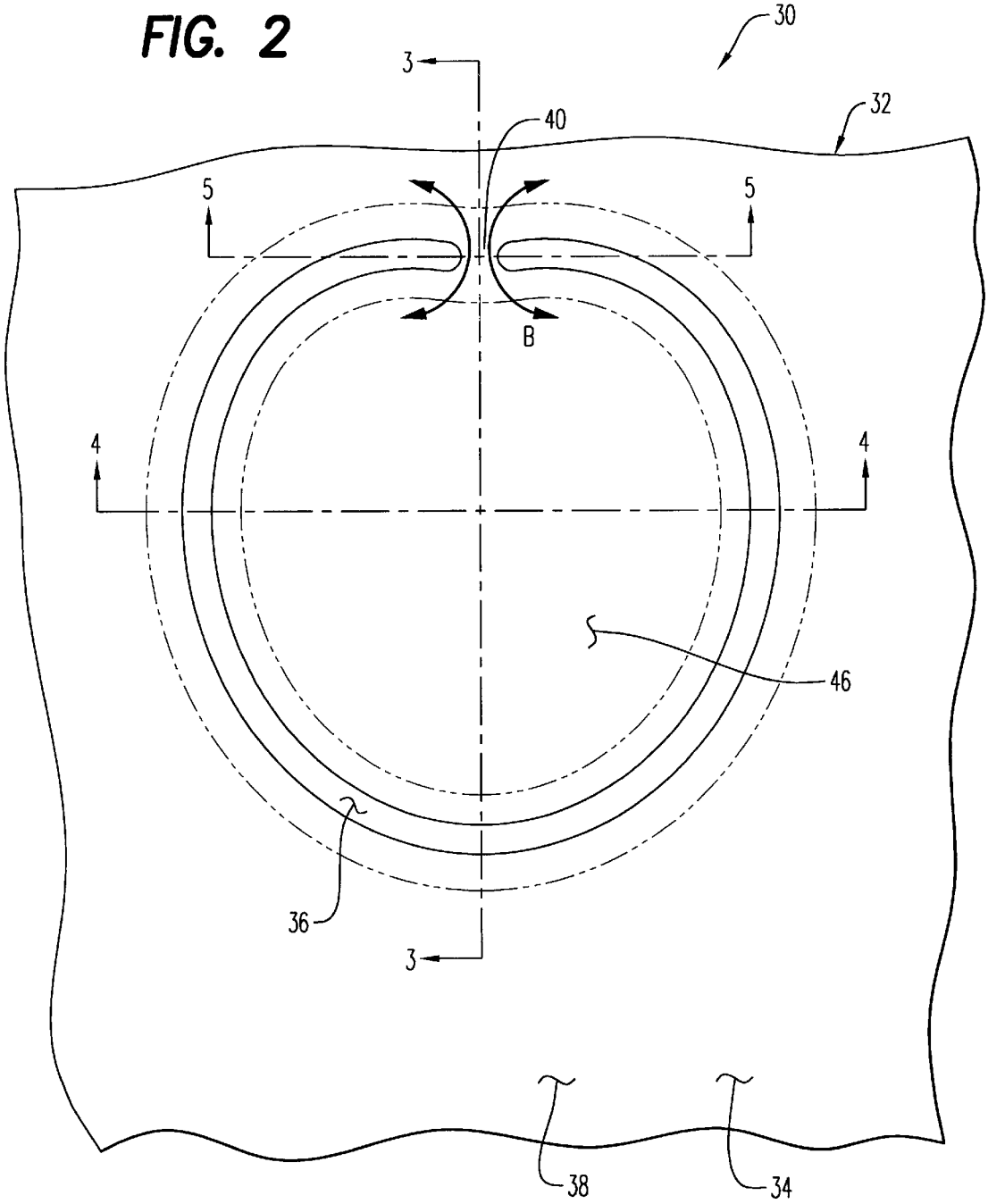
FIG. 2 is an enlarged top plan view of a portion of another embodiment of the invention.
Figure 3:
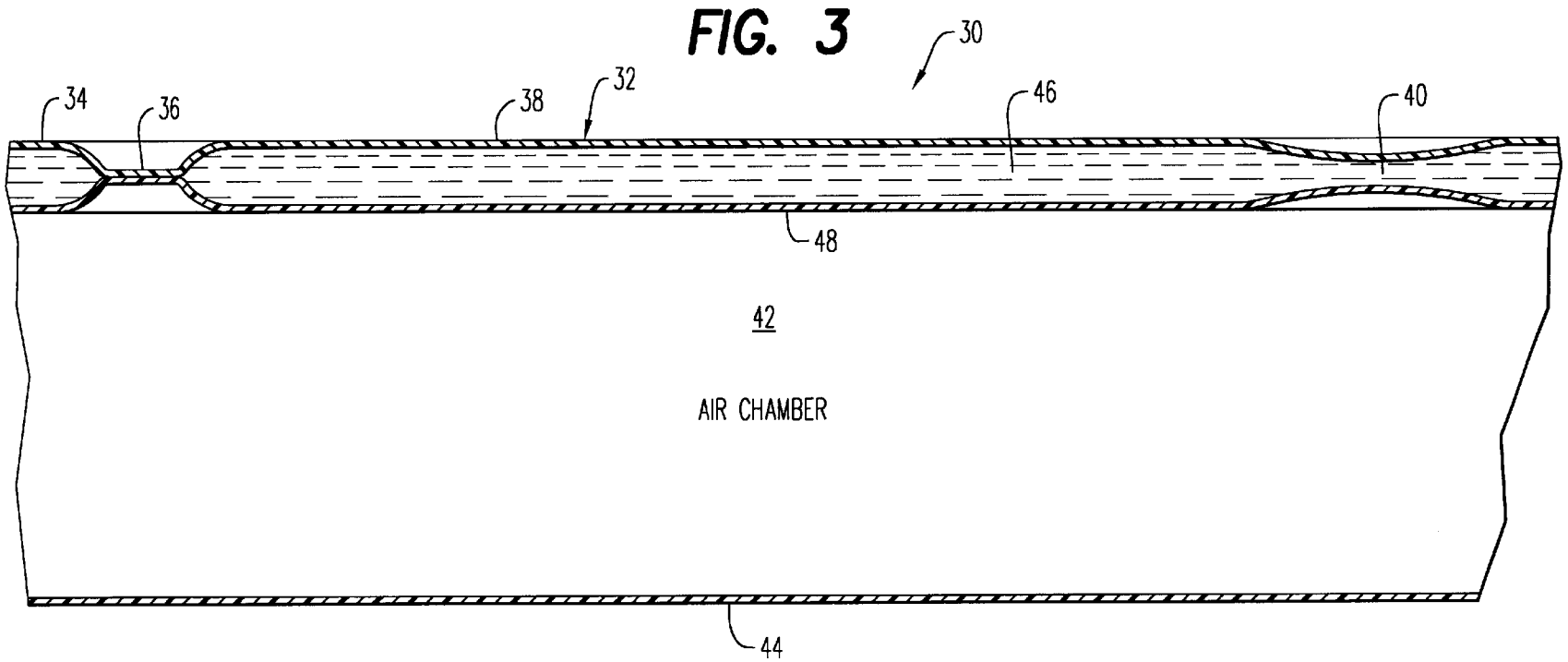
FIG. 3 is a section view in the direction of arrows 3—3 in FIG. 2.
Figure 4:
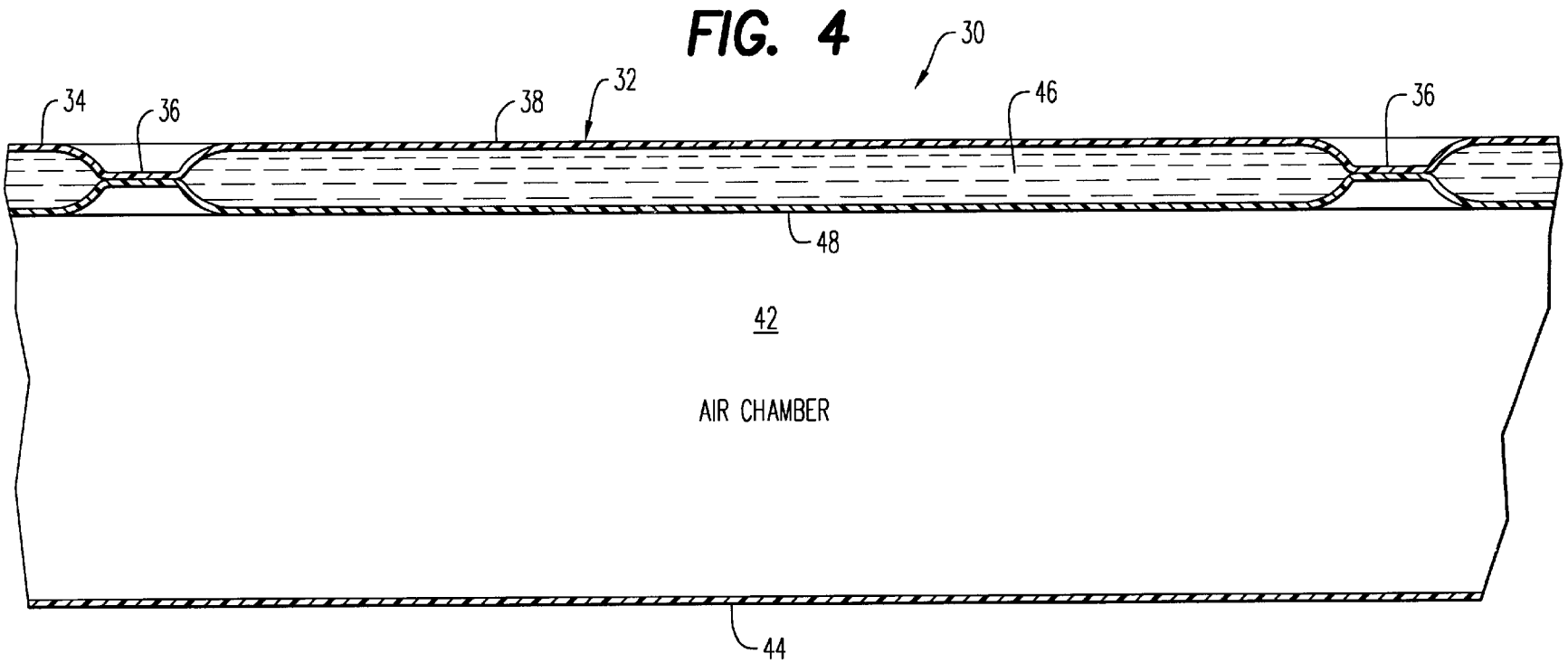
FIG. 4 is a section view in the direction of arrows 4—4 in FIG. 2.
Figure 5:
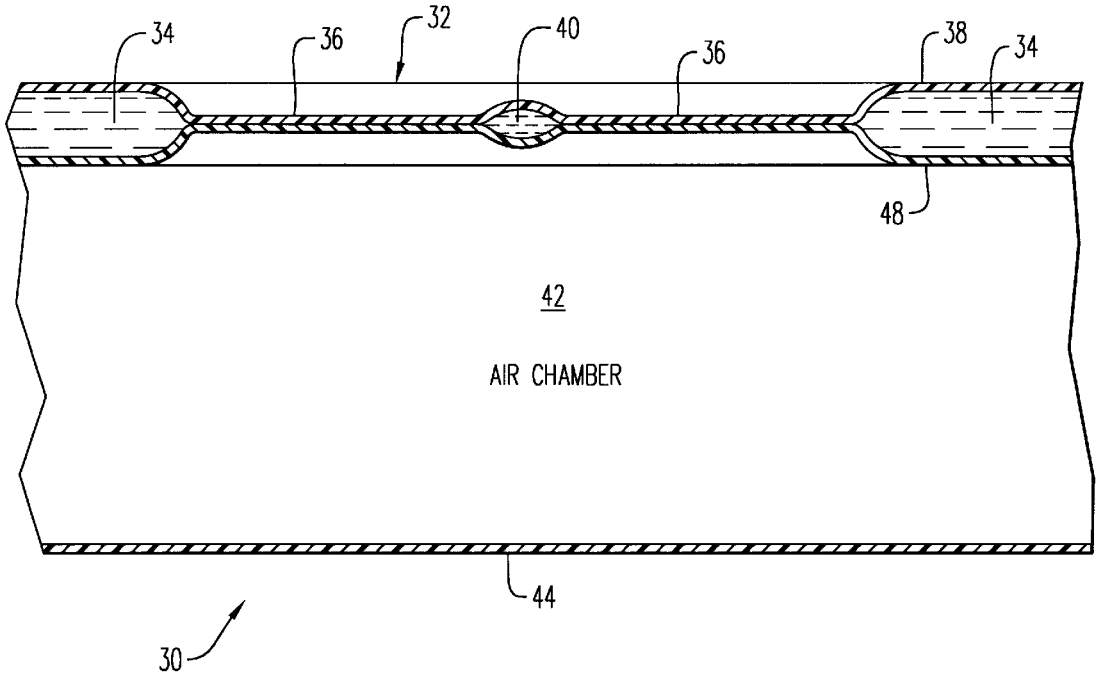
FIG. 5 is a section view in the direction of arrows 5—5 in FIG. 2.

Referring now to FIG. 1, a generic example of the invention is there shown at numeral 10. This embodiment 10 includes an inflatable lower air chamber 12 atop which is positioned an upper water-fillable layer 14. The lower air chamber 12 is of a conventional nature formed of flexible air-tight material and having an air fill valve 24 formed into a surface thereof, while the upper water layer 14 also includes a water fill valve 26 formed in a top panel thereof. The upper water filled layer 14 is formed of a portion of an upper layer 28 of the air chamber 12 and a top panel 20 which are sealingly connected along the margins thereof to the upper layer 14.

The upper layer 14 includes an array or a plurality of individual pockets 18. Each pocket 18 is formed by the sealing connection between the upper layer 28 of the air chamber 14 and the top panel 20 along any desired shape defining a mostly closed or sealed perimeter 16 of each of the pockets 18. Only a small port 22 remains unsealed.

By this arrangement, as the upper layer 14 is filled with water through the water valve 26, water enters into each of the pockets 18 through port 22 in the direction of arrow A. Once the entire upper water-filled layer 14 is filled as desired and the valve 26 sealed, as the device 10 is used, normal movement and motion both of the entire device 10 and as it is used to support the weight of a user's body will not easily cause the water to slosh or flow from each of the water filled pockets 18. Therefore, the sloshing or pooling of water within the relatively thin upper layer 14 is substantially eliminated and maintained in a generally uniform thickness of water in the upper layer 14. A thickness ratio between the lower air chamber 12 and the upper water-filled layer 14 is preferable, in the range of up to about 10 to 1.

Referring now to FIGS. 2 to 5, another embodiment of the invention is there shown at numeral 30 and includes a lower air chamber 42 defined by air tight flexible plastic sheets 44 and 48 adhered together to form the air-tight structure of the lower air chamber 42. In this embodiment 30, each of the pockets 38 (only one shown) of the upper water filled layer 32 which are positioned directly atop the air chamber 42 have a common flexible air-tight and water-tight panel 48 positioned therebetween. The perimeter 36 of each of the pockets 38 is formed by the heat-sealing connection to define perimeter 36 between the upper panel of the air chamber 42 and the top panel 38 of the upper water layer 32 in any desired ornamental configuration. Only a small portion of this sealed perimeter 36, which defines each of the pockets 38, is left unsealed to define a water port 40 into which, and out of which, water may flow in the direction of arrows B in FIG. 3.

By this arrangement, after the upper layer 32 is filled with water, all of the pockets 38 are also filled with water as water pressure is slowly equalized. Thereafter, the water is very slow to flow from each of the pockets 38 depending upon the size of the water port 40. Therefore, during use of the device 30, whether it be as it is moved or rested upon, the water within the upper layer 32 will not easily slosh or flow out of the pockets 38 so as to cause excessive pooling within the upper layer 32 which would result in a non-uniform water layer thickness and uneven body support.

Alternate embodiments of the invention are shown in FIGS. 6 and 7. In FIG. 6, an oversized floor-supported chair is there shown at 50 and includes air chambers 52 and 54 as shown. Each of these air chambers 52 and 54 include air fill valves 62 and 66 and also include an upper water-filled layer 56 and 58, respectively. Each of these upper layers 56 and 58 are water tight and are filled through fill ports 60 and 64, respectively, and further include individual pockets 60 and 62, respectively, which are formed by heat sealing the perimeters thereof over all but a small portion thereof to leave a water flow port allowing water to flow into and out of each of these pockets 60 and 62 respectively, as previously described.

In FIG. 7, an inflatable chaise lounge embodiment of the invention is shown generally at numeral 70 and includes an air chamber 72 defining the lower portion of the chaise lounge 70 and an upper water-filled layer 74 substantially thinner than that of the air chamber 72. Again, a water fill valve 78 is provided to fill the upper layer 74 and the individual ported pockets 76 as above described. An air valve 80 is provided for inflating the air chamber 72.

Note importantly that both of the embodiments 50 and 70 in FIGS. 6 and 7, respectively, include portions thereof wherein a segment of the air chamber is not below, but rather along side the water-filled layer. The broad aspect of the invention facilitates this side-by-side arrangement of air chamber and water-filled layer. The pockets prevent or greatly inhibit water flow from each of the pockets through the corresponding port so that the overall thickness of the water-filled layer is maintained rather than pooling by gravity or body presence.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A fluid-containing air cushion comprising:

an air chamber including an air fill valve;

a water-fillable layer connected against, and at least partially coextensive with, said air chamber and defining a body support surface;

said water-fillable layer including a water fill valve and an array of individual spaced fluid pockets each of which is separated from, but in fluid communication with, said water-fillable layer by a single fluid flow port whereby, as said water-fillable layer is filled with water, water flows into each of said fluid pockets through said port and is substantially trapped within each of said fluid pockets to prevent substantial sloshing, uneven distribution or pooling of water within said water-fillable layer.

* * * * *